US005630746A

United States Patent [19]

Gottschald et al.

[11] Patent Number: 5,630,746

[45] Date of Patent: May 20, 1997

[54] SPECTACLE LENS EDGE GRINDING MACHINE

[75] Inventors: Lutz Gottschald, Meerbusch; Klaus Eickmeyer, Haan, both of Germany

[73] Assignee: Wernicke & Co. GmbH, Düsseldorf, Germany

[21] Appl. No.: 578,575

[22] PCT Filed: Jun. 15, 1994

[86] PCT No.: PCT/EP94/01945

§ 371 Date: Dec. 22, 1995

§ 102(e) Date: Dec. 22, 1995

[87] PCT Pub. No.: WO95/00292

PCT Pub. Date: Jan. 5, 1995

[30] Foreign Application Priority Data

Jun. 24, 1993 [DE] Germany ..... 43 20 934.3

[51] Int. Cl.[6] ..... B24B 49/00

[52] U.S. Cl. ..... 451/5; 451/42; 451/43; 451/44; 451/255; 451/256

[58] Field of Search ..... 451/5, 12, 41, 451/42, 43, 44, 240, 255, 256, 8, 9

[56] References Cited

U.S. PATENT DOCUMENTS

| | | | |
|---|---|---|---|
| 3,673,738 | 7/1972 | Stern . | |
| 4,596,091 | 6/1986 | Daboudet et al. | 451/43 |
| 4,829,715 | 5/1989 | Langlois et al. | 451/43 |
| 5,148,637 | 9/1992 | Byron | 451/5 |
| 5,157,878 | 10/1992 | Hiyoshi et al. . | |
| 5,161,333 | 11/1992 | Lecerf et al. | 451/43 |
| 5,321,915 | 6/1994 | Lecerf et al. | 451/5 |
| 5,363,597 | 11/1994 | Gottschald et al. | 451/240 |

FOREIGN PATENT DOCUMENTS

| | | |
|---|---|---|
| 2648244 | 12/1990 | France . |
| 8706215 | 10/1988 | Germany . |
| 3842601 | 7/1990 | Germany . |
| 4012660 | 10/1991 | Germany . |
| 4235212 | 4/1993 | Germany . |
| 4320934 | 1/1995 | Germany . |

*Primary Examiner*—Robert A. Rose
*Assistant Examiner*—George Nguyen
*Attorney, Agent, or Firm*—Robert W. Becker & Associates

[57] ABSTRACT

A spectacle lens edge grinding machine includes a machine frame and at least one grinding wheel connected to the machine frame. A rotatable spectacle lens holding shaft is fastened to the machine frame. The spectacle lens holding shaft is at least radially displaceable relative to the grinding wheel. A spectacle lens is secured to the spectacle lens holding shaft for grinding with the grinding wheel. At least one abutment is provided for contacting a spectacle lens having been ground to have a desired spectacle lens contour. A transducer for measuring at least one actual value of the spectacle lens contour relative to the at least one abutment is provided. A computer for controlling the spectacle lens edge grinding machine is provided, wherein the computer includes a memory in which nominal values of the spectacle lens contour are stored. The computer compares the at least one actual value to the nominal values in order to determine a deviation from the nominal values. The memory stores a programmable threshold value for the deviation and the computer controls an additional grinding step when the deviation surpasses the threshold value.

17 Claims, 3 Drawing Sheets

SPECTACLE LENS EDGE GRINDING MACHINE

BACKGROUND OF THE INVENTION

The invention relates to a spectacle lens edge grinding machine in which in a pregrinding step the spectacle lens receives its circumferential contour, is subsequently subjected to a finishing step, especially a facet grinding step, the circumferential data of the circumferentially ground lens is determined, input into a computer, and the radial movement, and optionally the axial movement, of the spectacle lens relative to the grinding wheel is computer-controlled with the aid of the circumferential data in an optionally subsequently performed corrective grinding step with the aid of the peripheral data with the computer.

Such a device is disclosed in German Patent 40 12 660 of the assignee. In this device the data of the circumferential contour of the spectacle lens is determined and input into the computer during or after completion of the fine-grinding step with a transducer, operating contactless and arranged in a housing of the spectacle lens edge grinding machine. The determined actual values of the circumferential contour are compared within the computer with nominal values of the circumferential contour stored therein, and reaching or surpassing of a predetermined permissible deviation is detected, whereby finishing grinding is performed only upon surpassing the permissible deviation with control based on the corrective values resulting from this deviation.

Even though the principle of determining the actual values of the circumferential contour of form-ground spectacle lenses and the thus optionally resulting corrective grinding have been proven successful, it has been shown in practice that the contact-free operating transducers arranged within the housing are disadvantageously effected by the atmosphere present in the area of the spectacle lens within the housing of the spectacle lens edge grinding machine which atmosphere is loaded more or less uniformly by splashing cooling media and abrasive grit, so that it is required, when exact measuring results and exact grinding results based thereon are to be achieved, to perform a frequent cleaning.

Upon grinding the V-shaped bevel of a spectacle lens wear of the grinding wheel at the V-shaped bevel groove results which not only results in an enlargement of the finish-ground spectacle lens, but also in an increase of the acute angle of the V-shaped bevel, i.e., a flattening of the bevel. The flattening of the V-shaped bevel can be accepted to a certain extent, as long as the spectacle lens is securely held within the bevel groove of the respective spectacle frame. This requires, however, that the circumferentially ground spectacle lens is subjected to a corrective grinding which takes into consideration the flattening of the bevel.

It is thus an object of the invention to overcome the disadvantages of the known spectacle lens edge grinding machines and to design the transducer such that with a simple construction, independent of the atmosphere, the resulting soiling and optionally present deposits within the housing of the spectacle lens edge grinding machine, a sufficiently exact measuring result can be obtained. Furthermore, the measuring results should additionally take into consideration changes of the V-shaped bevel due to wear of the grinding wheel used for manufacturing the V-shaped bevel.

SUMMARY OF THE INVENTION

Based on this object, it is suggested for the spectacle lens edge grinding machine of the aforementioned kind that it comprise at least one abutment cooperating in a contacting manner with the circumferentially ground spectacle lens and a transduces for receiving at least one actual value of the circumferential contour with respect to the abutment.

Accordingly, the spectacle lens edge grinding machine according to the present invention is primarily characterized by:

- a machine frame;
- at least one grinding wheel connected to the machine frame;
- a rotatable spectacle lens holding shaft fastened to the machine frame, the spectacle lens holding shaft being at least radially displaceable relative to the grinding wheel, wherein a spectacle lens is secured to the spectacle lens holding shaft for grinding with the grinding wheel;
- at least one abutment for contacting a spectacle lens having been ground to have a desired spectacle lens contour;
- a transducer for measuring at least one actual value of the spectacle lens contour relative to the at least one abutment;
- a computer for controlling the spectacle lens edge grinding machine, wherein the computer comprises a memory in which nominal values of the spectacle lens contour are stored;
- wherein the computer compares the at least one actual value to the nominal values in order to determine a deviation from the nominal values; and
- wherein the memory stores a programmable threshold value for the deviation and wherein the computer controls an additional grinding step when the deviation surpasses the threshold value.

Preferably, the abutment is a ring positioned laterally adjacent to the at least one grinding wheel so as to be stationary relative to the grinding wheel, wherein the spectacle lens after grinding the spectacle lens contour is transferred from a position at the grinding wheel to a position at the abutment. The ring is expediently comprised of ring segments.

One of the rings is positioned on either side of the grinding wheel and the rings comprise a sensing head for measuring a spatial curve of the spectacle lens contour.

The machine preferably further comprises a control device for controlling an axial position of the spectacle lens holding shaft together with the spectacle lens relative to the grinding wheel as a function of the spatial curve of the spectacle lens contour, wherein the control device is also operative when the actual values are measured.

In another embodiment the machine further comprises a stationary splash guard enclosing tightly the at least one grinding wheel exclusive a grinding zone for grinding the spectacle lens, wherein the rings are connected to the splash guard.

The at least one abutment is a sensing head comprising a wedge-shaped groove for detecting a radial value of the spectacle lens, wherein lateral sides of the wedge-shaped groove are positioned at an acute angle and wherein the acute angle is identical to a maximum acute angle of a V-shaped bevel of the spectacle lens.

The sensing head in addition to the wedge-shaped groove has a plane area for determining at least one radial value of a tip of the V-shaped bevel of the spectacle lens.

The machine preferably further comprises a drive comprising an adjustable clutch for radially displacing the at least one grinding wheel relative to the spectacle lens holding shaft. It may further comprise a switching device acting on the clutch so as to reduce a transferred torque during measuring the actual value of the spectacle lens contour.

The machine may further comprise a compound slide rest connected to the machine frame, wherein the at least one grinding wheel with the drive are connected to the compound slide rest so as to be displaceable relative to the spectacle lens holding shaft, wherein the transducer measures a displacement of the compound slide rest within the machine frame relative to the spectacle lens contour.

The transducer is preferably a digital transducer.

This abutment can be connected fixedly or displaceably with respect to the spectacle lens holding shaft and the spectacle lens to a machine frame of the spectacle lens edge grinding machine. The spectacle lens is transferred onto this abutment after its contour has been circumferentially ground, and the radius of a predetermined associated angle of at least one circumferential point of the spectacle lens with ground circumferential contour is measured relative to the abutment.

In general, the abutment can be positioned at any desired location within the housing of the spectacle lens edge grinding machine, however, must be accessible as an abutment for the circumferentially ground spectacle lens. An especially simple and preferred embodiment of the abutment results when it is comprised of narrow rings, respectively, ring segments arranged laterally to the grinding wheel, respectively, grinding wheels which are stationary relative to the grinding wheel and onto which the spectacle lens, after grinding of the circumferential contour, is transferred.

In order to take into account changes of the V-shaped bevel due to wear of the grinding wheel used for the manufacture of the V-shaped bevel in the measuring results, the sensing head for measuring the radius value may have a wedge groove with a wedge angle that is identical to the permissible maximum acute angle of the V-shaped bevel at the spectacle lens.

When the circumferentially ground spectacle lens is inserted into the wedge-shaped groove, a measured radius will depend solely on the radial wear of the grinding wheel as long as the angle of the V-shaped bevel of the circumferentially ground spectacle lens does not surpass the angle of the wedge-shaped groove at the sensing head. Until the two angles become identical, it is sufficient to perform a corrective grinding step that corresponds to the linear deviation.

When the wear of the grinding wheel to be used for the facet grinding is so great that the angle of the V-shaped bevel is greater than the angle of the wedge-shaped groove at the sensing head, the spectacle lens to be measured with its V-shaped bevel can no longer be inserted completely into the wedge-shaped groove so that a greater deviation is measured as is associated with the linear diameter change of the grinding wheel. In this case, the spectacle lens edge grinding machine can stop the grinding process and send a signal that provides information to the operators with regard to the grinding wheel having to be adjusted, respectively, being no longer usable.

It can be especially easily detected whether the angle of the V-shaped bevel at the contour-ground spectacle lens has surpassed a predetermined value when the sensing head, in addition to the wedge-shaped groove, has a flat area for an unchanged position of the spectacle lens and when at least a radius value of the tip of the V-shaped bevel at the wedge-shaped groove and a further radius value with respect to the flat area is measured. From the difference of these two values in comparison to the nominal value it can be determined easily whether the change is still within permissible limits or not.

Advantageously, the grinding wheel(s) may be tightly enclosed by a stationary splash guard with the exception of the grinding zone, and the rings, respectively, ring segments can be arranged at the splash guard.

These rings, respectively, ring segments can be arranged preferably on both sides of a pregrinding wheel and may be embodied as a sensing head for determining the spatial curve of the circumferential of the spectacle lens. Such a device is disclosed in German Patent 38 42 601 of the assignee and serves to determine the front and back spatial curve of the circumferential contour of the form-ground spectacle lens as well as the respective thickness of the lens. This is achieved by carrying out oscillating reciprocal movements of the spectacle lens holding shaft together with the spectacle lens or of the grinding wheel together with the sensing head relative to one another. This, on the one hand, serves to ensure a uniform wear of the pregrinding wheel and, on the other hand, to measure the spatial curve and the lens thickness of the form-ground spectacle lens. In this manner the computer present within the device according to German Patent 38 42 601 can be used not only to change the axial position of the spectacle lens holding shaft together with the spectacle lens relative to the grinding wheel according to the spatial curve of the contour of the spectacle lens for a controlled grinding of a V-shaped bevel, but also for determining the actual values of the circumferential contour by means of the rings, respectively, ring segments. Thus, they can be embodied to be very narrow because, due to the control of the axial position of the spectacle lens holding shaft together with the spectacle lens relative to the grinding wheel according to the spatial curve of the contour of the spectacle lens, there is no danger that the spectacle lens, when measuring the circumferential contour, leaves the area of the abutment and reaches the pregrinding disk or the finish-grinding disk or the intermediate spaces.

In order to prevent grinding traces on the rings, respectively, ring segments and/or the circumferentially contour-ground spectacle lens and a thus resulting falsification of the measuring results, the contacting of the spectacle lens at the rings, respectively, ring segments can be effected by a drive which comprises an adjustable clutch. Its clutch moments can be changed in the sense of reduction during measuring the actual values of the circumferential contour with a switching device.

When the grinding wheel with its drive is connected to a compound slide rest so as to be displaceable relative to the spectacle lens holding shaft rotatably supported at the machine frame, the transducer can be arranged such that it measures the displacement of the compound slide rest within the machine frame relative to the circumferential contour of the circumferentially contour-ground spectacle lens. Since the compound slide rest within the machine frame is arranged external to a tank for receiving cooling liquid and the abrasive grit, the transducer is not negatively affected by the atmosphere present within the area of the grinding wheels and the spectacle lens to be ground.

Analogously, the transducer can be arranged relative to the spectacle lens holding shaft when the latter is axially and radially movably supported at the machine frame relative to the rotating grinding wheels in order to measure the actual values of the circumferential contour.

Preferably, a digital transducer can be used wherein the measured values are directly input to the computer and processed therein.

The present invention also relates to a method for grinding the edge of a spectacle lens with a spectacle lens edge grinding machine, the method comprising the steps of:

a) measuring at least one actual radius of a predetermined angle at a peripheral point of a spectacle lens, ground to have a spectacle lens contour, relative to an abutment;

b) inputting the at least one measured actual radius into a computer with a memory;

c) comparing the at least one measured actual radius with a corresponding nominal radius stored in the memory of the computer to determine a deviation from the nominal radius;

d) comparing the deviation to a threshold value stored in the memory of the computer; and e) controlling with the computer an additional grinding step, when the deviation surpasses the threshold value, for correcting the spectacle lens contour in order to compensate for the deviation.

Preferably, in the step a) the actual radius is a radius of a circumferential V-shaped bevel of the spectacle lens and is measured relative to a wedge-shaped groove of the abutment.

In the step a) the actual radius is additionally measured relative to a plane area provided at the abutment. The method further includes the step of comparing the measured values measured relative to the wedge-shaped groove and relative to the plane surface in order to determine whether a correction of the deviation of the actual radius, measured relative to the wedge-shaped groove, is possible.

Advantageously, in the step a) the actual radii of the entire spectacle lens contour are measured, wherein in the step c) the actual radii are compared to the stored nominal radii of the entire spectacle lens contour to determine the deviations from the nominal radii. The method further includes the step of signalling the deviations when the deviations surpass the threshold value, and the step of averaging the deviations so as to perform the step e) according to the averaged deviation.

Preferably, in the step a) the actual radii of the entire spectacle lens contour are measured. In the step c) the actual radii are compared to the stored nominal radii of the entire spectacle lens contour to determine the deviations from the nominal radii, and in the step e) only such areas of the spectacle lens contour are corrected in which the deviations surpass the threshold value.

The step a) includes the step of rotating the spectacle lens at a rpm higher than the rpm for grinding the spectacle lens.

The inventive method for grinding the edges of spectacle lenses with the aforedescribed spectacle lens edge grinding machine can preferably be comprised of the steps of measuring the radius of a predetermined associated angle of at least one circumferential point of the circumferential contour of the form-ground spectacle lens with respect to an abutment, inputting the measured value into the computer, comparing it to a stored nominal value, and, upon surpassing a stored permissible deviation of the actual value with respect to the nominal value, performing an additional grinding process of the circumferential contour with a corresponding correction based on the deviation.

Preferably, the radius of at least one circumferential point of the V-shaped bevel of the circumferentially ground spectacle lens with respect to a wedge-shaped groove at the abutment can be measured, so that it is recognizable whether the angle of the V-shaped bevel is still within the range of permissible values. In this scenario, with an additional grinding process of the circumferential contour with a correction corresponding to the deviation a still usable spectacle lens can be produced.

When the angle of the V-shaped bevel of the circumferentially contour-ground spectacle lens is greater than the angle of the wedge-shaped groove, this means, that the grinding wheel which has been used for grinding the V-shaped bevel must be adjusted, respectively, has become unusable. This is indicated by the machine with a respective signal.

When the radius of at least one circumferential point of the V-shaped bevel of the circumferentially contour-ground spectacle lens is measured relative to the wedge-shaped groove at the abutment as well as relative to the plane area of the abutment, it can be determined in a simple manner by comparing these measured values whether a correction of the deviation of the actual value from the nominal value, measured with respect to the wedge-shaped groove, is still possible, respectively, whether the spectacle lens must be reground with a new or adjusted grinding wheel.

When only one circumferential point is measured, the correction of the entire circumferential contour is based on the deviation measured at this point. When this deviation results only from wear of the pregrinding wheel or of the finish-grinding wheel, which, in general, is uniformly distributed over the circumference, a sufficiently exact circumferentially contour-ground spectacle lens can be manufactured with this correction whose size is precise enough to be directly inserted into a certain spectacle frame.

Since the deviations about the circumferential contour may vary, whereby these deviations are determined by the shape of the spectacle lens and the spatial curve of the circumferential contour, a greater precision of the corrective grinding step can be achieved when the entire circumferential contour is measured, the values compared to the stored nominal values, upon surpassing the threshold value of the permissible deviation of the actual value relative to the nominal value the measured deviations are averaged by the computer, and the additional grinding process of the circumferential contour is performed corresponding to the averaged values. In all cases, a corrective grinding step is performed in order to maintain the actual value of the circumferential values at 0:0.3 mm relative to the nominal values.

An even more precise correction of the circumferential contour can be achieved when the entire circumferential contour is measured, compared to the stored nominal values, and, when locally deviations of the actual value with respect to the nominal values surpass the permissible deviation, an additional grinding process is carried out only in areas that have an impermissible deviation of the circumferential contour.

In order not to lose too much time for measuring the entire circumferential contour of a formground spectacle lens, this measuring step can be performed at rpm of the spectacle lens holding shaft that are higher than the conventional rpm during the grinding process.

The inventive correction of the circumferential contour of the spectacle lens can be performed with spectacle lens edge grinding machines in which the contour of the spectacle lens is predetermined by a template. This template is connected to the spectacle lens holding shaft and rests on an adjustable abutment that can be inventively adjusted by the computer for a corrective grinding step as disclosed above. In such a spectacle lens edge grinding machine the computer serves only to control the relative axial displacement of the grinding wheel and the circumferentially contour-ground spectacle lens during grinding of a facet, the measuring of the circumferential contour, and optionally the required corrective grinding step.

It is also possible to input into the computer the circumferential contour of a spectacle lens to be ground in the form of a set of data. In this case the template corresponding to the contour of the spectacle lens can be replaced by a circular disk and the movement of the abutment is controlled by the computer which movement determines the contour of the spectacle lens to be ground.

Finally, it is also possible to control the relative distance between the spectacle lens holding shaft and the grinding wheel directly by the computer, for example, with a compound slide rest which supports the grinding wheels and which has a corresponding drive. In this case, the inventive correction of the circumferential contour grinding step can also be performed in the aforementioned manner.

BRIEF DESCRIPTION OF THE DRAWINGS

The invention will be described in detail in the following with the aid of the embodiment represented in the drawings. The drawings show in.

DESCRIPTION OF THE PREFERRED EMBODIMENTS

Figure 1:
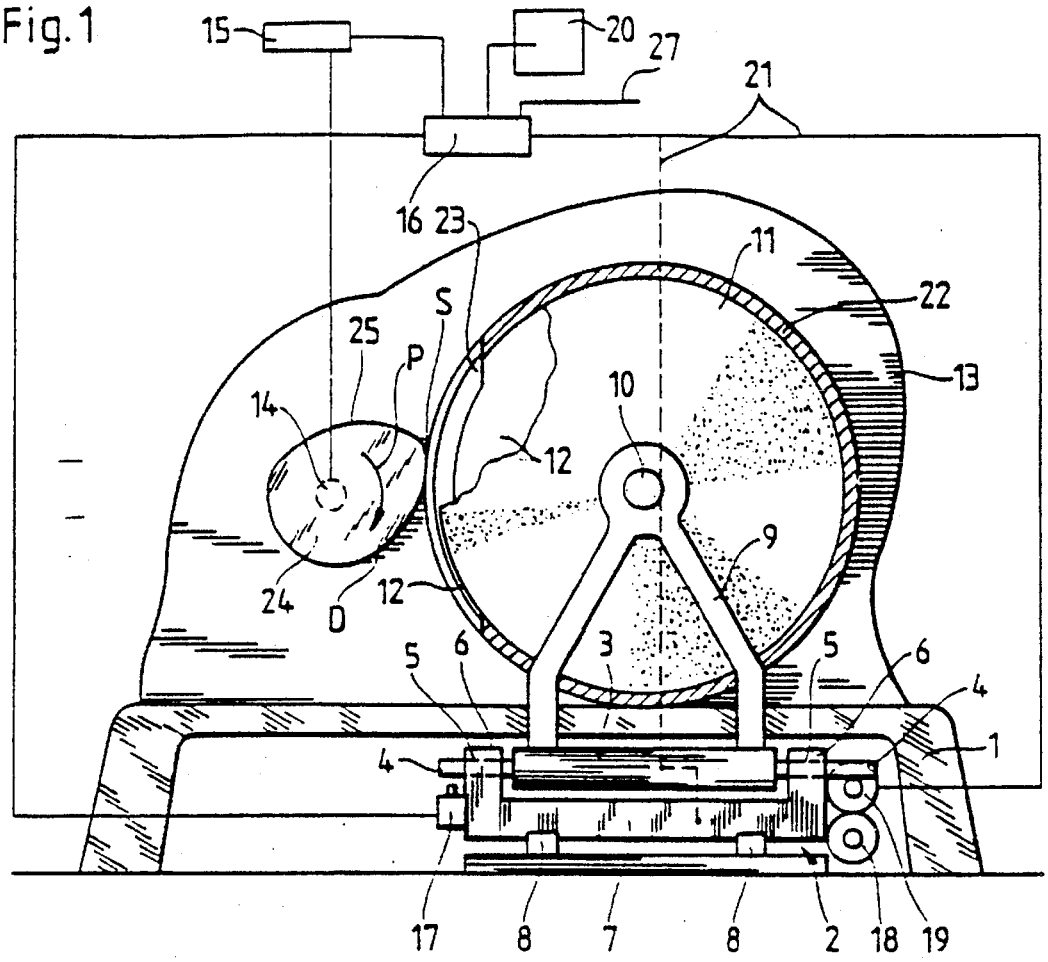
FIG. 1 a schematic side view of a spectacle lens edge grinding machine with representation of the inventive abutment and transducer.

A compound slide rest 2 is connected to a machine frame 1 and has a carriage part 3 with guide rods 4 which are supported in bores 5 of projections 6 of a carriage part 7 so as to be displaceable radially relative to the lens holding shaft 14 with a spectacle lens 24 secured thereat.

The carriage part 7 is arranged via guide tracks 8 at the machine frame 1 so as to be displaceable in a direction parallel to the lens holding shaft 14 and a shaft 10 for the pregrinding wheel 11 and a finishing and/or facet grinding disk 12 arranged coaxially thereto and having a facet groove 33.

The shaft 10 is supported with bearing supports 9 at the carriage part 3. The grinding wheels 11, 12 and the spectacle lens 24 with the shafts 10, 14 are surrounded by a housing 13 that at its bottom part comprises a tank (not represented in detail) which prevents that cooling liquid and abrasive grit can enter the area of the compound slide rest 2.

An angle transducer 15 is connected to the spectacle lens holding shaft 14 and to a computer 16.

A transducer 17 is arranged at the carriage part 7 and detects the radial displacement of the carriage part 3 relative to the spectacle lens holding shaft 14. This transducer 17 is also connected to the computer 16.

The radial displacement of the carriage part 3 is effected by a drive motor 18 which is controlled via the computer 16 and control lines 21. The present invention is, of course, in no way restricted to the specific disclosure of the specification and drawings, but also encompasses any modifications within the scope of the appended claims. drive motor 18 is in driving connection with guide rods 4 via an electromagnetic clutch 19.

In a nominal value memory 20 the circumferential contour values for different spectacle lens shapes are saved in the form of polar coordinates.

For grinding a preselected circumferential contour of a spectacle lens, a lens blank is clamped into the spectacle lens holding shaft 14 and is contacted with the pregrinding disk 11. The resulting contact pressure depends on the adjustment of the electromagnetic clutch 19 and is adjustable to different values for spectacle lenses made of plastic or silicate glass as well as with respect to the optical values of the spectacle lens such as thickness of the edge of the spectacle lens.

Figure 2:
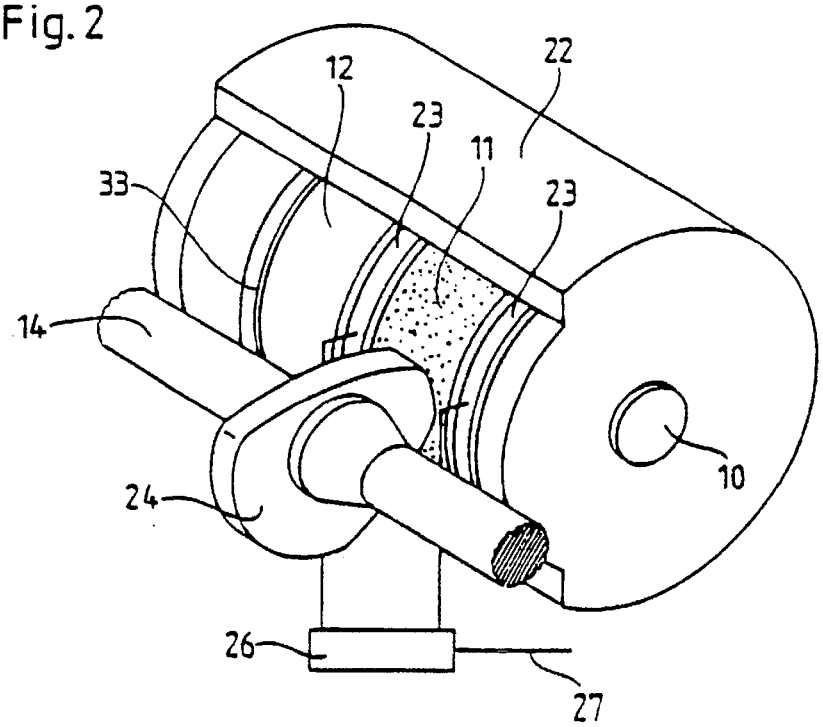
FIG. 2 a perspective representation of a splash guard enclosing two grinding wheels with abutments in the form of ring segments and a spectacle lens holding shaft arranged in front thereof with a lens that has been circumferentially ground.

The spectacle glass 24 is rotated in a manner known per se by the shaft 14 whereby the velocity of rotation is conventionally 10 to 13 rpm. The angular transducer 15 transmits to the computer 16 at identical angular distances, for example, in increments of 6°, an impulse so that the computer 16 adjusts the respective radius of the spectacle lens via the drive motor 18. During grinding of the circumferential contour of the spectacle lens 24 with the pregrinding wheel 11 the carriage part 7 and thus the grinding wheel 11 is in an oscillating movement parallel to the axis of rotation of the spectacle lens 24 which is always switched at the edge of the pregrinding wheel 11 to move in the opposite direction. This movement is controlled by a non-represented drive for the carriage part 7 which is also connected to the computer 16. On both sides of the pregrinding wheel 11 ring segments 23 are arranged which are connected to a splash guard 22 which is open within the contact area with the spectacle lens 24 and which encloses tightly the pregrinding wheel 11 and the finish-grinding wheel 12. The ring segments 23 serve as a sensing head and are connected with the sensor 26 which is schematically represented in FIG. 2. The sensor itself is connected with a control line 27 to the computer 16. The oscillating movement of the carriage part 7 and thus of the grinding disks 11, 12 and the splash guard 22 enclosing them are controlled in a manner disclosed in German Patent 38 42 601 by the sensor 26 and serve simultaneously to measure the circumferentially contour-ground spectacle lens 24 with respect to the spatial curve of the front and backside as well as the thickness of the glass. These measured values serve to grind with the facet groove 33 at the finish-grinding wheel 12 a bevel at the circumferentially contour-ground spectacle lens the course of which can be controlled by the computer 16.

After having ground with the pregrinding disk 11 the contour of the spectacle lens according to the representation in FIG. 1, the spectacle lens 24 is automatically transferred onto the finishing grinding wheel 12 and is precisely positioned relative to the facet groove 33. The spectacle lens 24 is provided with a sufficient material tolerance for carrying out the finish-grinding step.

After the finish-grinding step, the spectacle lens 24 controlled by the computer 16 is positioned precisely on the ring segments 23. The ring segment 23 serves as an abutment for measuring the distance between the spectacle lens holding shaft 14 and this ring segment 23. Which point of the spectacle lens 24 is to be placed onto the ring segment 23 is determined by the computer 16 pursuant to input commands. In the simplest case, it is sufficient that a single distance measurement is performed, for this point the deviation of the actual value to the respective nominal value saved within the nominal value memory 20 is determined, and, upon surpassing a preset deviation, a further fine grinding step with correction of these deviations is controlled by the computer. This method based on measuring only one value assumes that the deviations are substantially identical over the entire circumferential contour.

More precise is a measurement when the entire contour of the spectacle lens 24 is measured for a complete rotation of the spectacle lens 24 while resting at the ring segment 23. Since the ring segments 23 are very narrow in order to provide for a short axial extension of the grinding disks 11, 12 within the splash guard 22, the computer 16 imparts a movement to the carriage part 7 parallel to the axis of the shaft 14 which movement takes into consideration the spatial curve of the contour of the spectacle lens, respectively, of the bevel, so that the spectacle lens 24 during this one rotation for measuring the circumferential contour remains on the ring segment 23. The distance values of the spectacle glass 24 are detected with the transducer 17 and sent to the computer 16 where a comparison with the nominal values takes place.

When based on the comparison of the actual values with the nominal values an impermissible deviation of the contour of the spectacle lens results, the computer 16 can then average the deviations over the circumference and provide for a correction based on this average value, or the deviations are recorded point by point, compared with the corresponding nominal values, and a corrective grinding step is performed only where actually a deviation has been detected.

When the measurement is performed exclusively such that the circumferentially ground spectacle glass is placed with its V-shaped bevel onto a flat area of the ring segment 23, it is possible to detect only a deviation in the diameter of the grinding disk 23 and to optionally correct it.

In FIGS. 3 to 7 it is shown that wear of the facet groove 33 of a grinding disk 12 not only results in a diameter change but also in an angle change of the V-shaped bevel.

Figure 7:
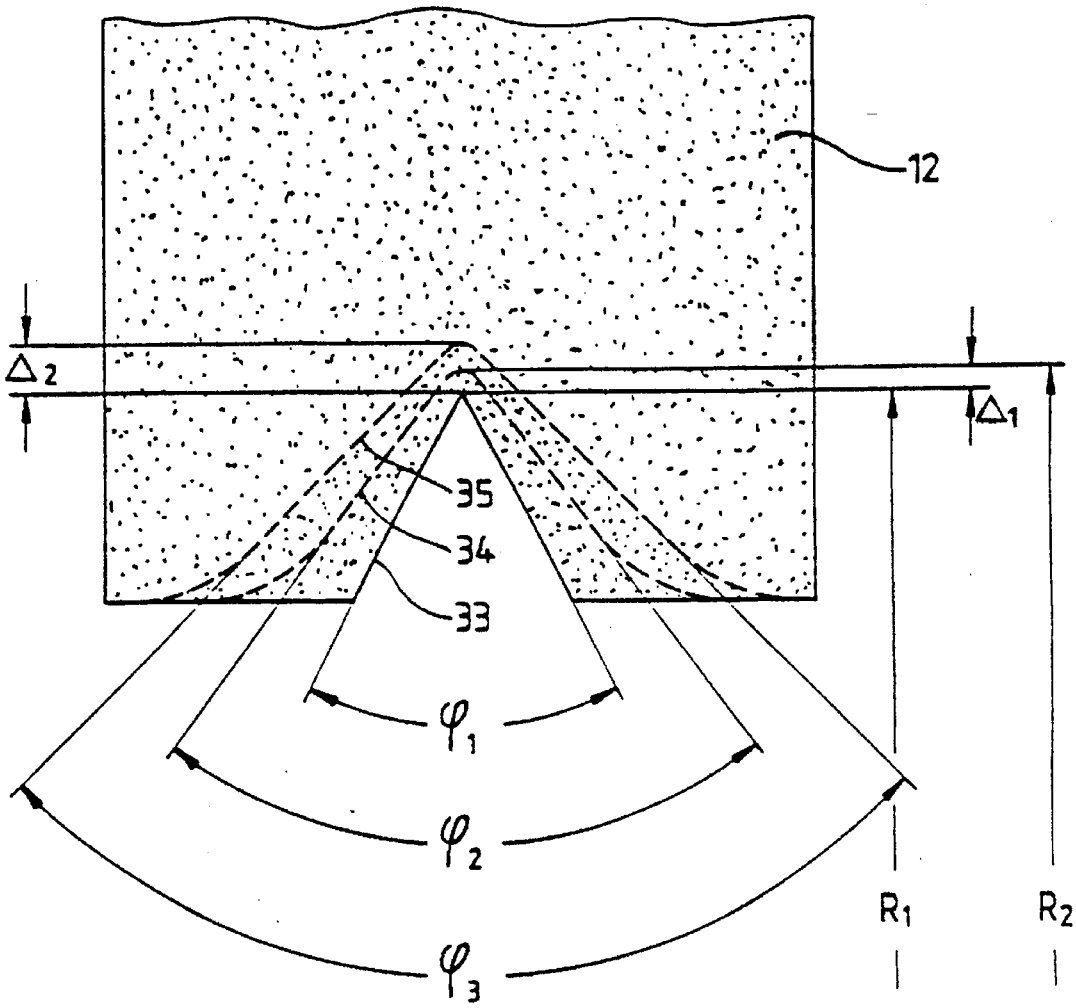
FIG. 7 an enlarged representation of a facet groove in a grinding wheel in a new and various worn states.

In FIG. 7 a finish-grinding wheel 12 is represented with a facet groove 33 in solid lines which has an angle $\rho_1$ which is smaller than the conventional angle of the facet groove within a spectacle frame. A precisely contour-ground spectacle lens can thus be inserted without problems in a corresponding spectacle frame and rests with the tip of the bevel at the base of the facet within the spectacle frame.

Figure 3:
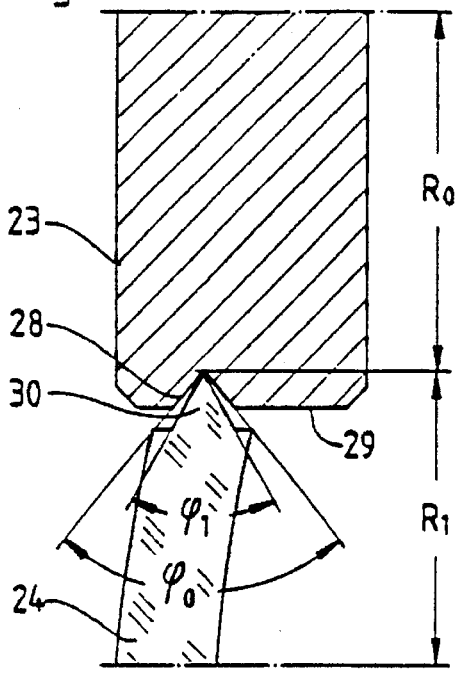
FIG. 3 a representation of a detail measuring at least one radius of the circumferentially ground spectacle lens with a V-shaped bevel ground with a new grinding wheel.
Figure 4:
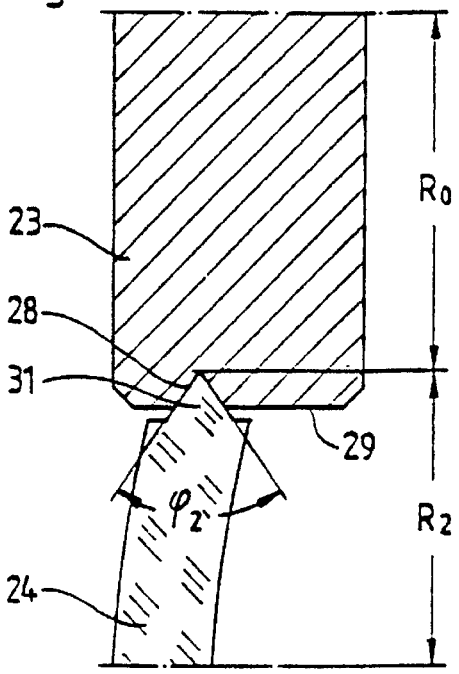
FIG. 4 a representation similar to FIG. 3 in which the bevel has been ground with a grinding wheel that is worn pasta permissible limit.

FIG. 3 shows this state with respect to the wedge-shaped groove 28 within the ring segment 23. This wedge-shaped groove 28 has an angle $\rho_0$ which is greater than the angle $\rho_1$ of the facet groove 33 within the finish-grinding wheel 12 and is substantially identical to the angle of the facet groove in conventional spectacle frames.

When a circumferentially contour-ground spectacle lens 24 with its V-shaped bevel 30 is inserted into the wedge-shaped groove 28 of the ring segment 23, the radius $R_1$ can be determined for this point. When this measured radius $R_1$ deviates from a preset nominal value and is too great, the spectacle lens 24 is automatically returned to the finishing grinding wheel 12 and a corrective grinding step is performed. In the course of time, the facet groove within the finish-grinding wheel 12 will wear and will assume the shape shown with cross-hatched and identified with reference numeral 34 in FIG. 7. The angle of this facet groove of a worn finish grinding wheel 12 is identified with $\rho_2$. It is shown that simultaneously the depth of the facet groove 34 has increased by the amount $\Delta_1$. When a contour-ground spectacle lens 24 with a V-shaped bevel having an angle $\rho_2$ is inserted according to FIG. 4 into the wedge-shaped groove 28 of the annular segment 23, a measured radius $R_2$ results which is greater by the amount $\Delta_1$ than $R_1$. In this case, a corrective grinding step can still be performed which will reduce the size of the contour-ground spectacle lens 24 by the value $\Delta_1$.

Figure 5:
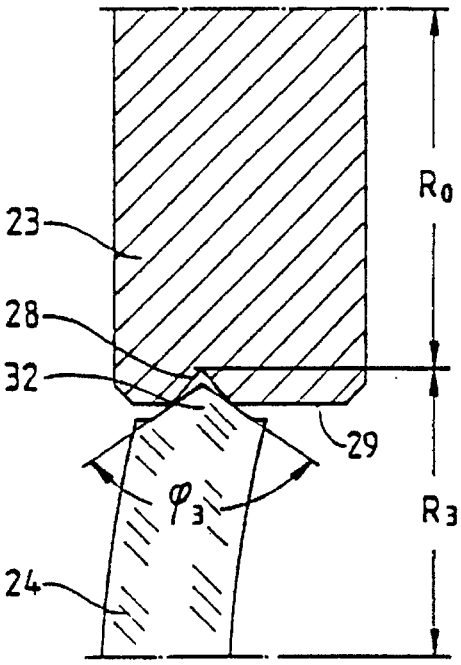
FIG. 5 a representation according to FIG. 3 in which the V-shaped bevel produced with a greatly worn grinding wheel is already so flat that the spectacle lens can no longer be inserted into a spectacle frame.

When the finishing grinding wheel 12 is worn down to such an extent that the facet groove 35 has the angle $\rho_3$, to which corresponds an enlargement of the depth having the value $\Delta_2$, this flattened V-shaped bevel with the angle $\rho_3$ can no longer be completely introduced into the wedge-shaped groove 28 at the ring segment 23 but rests with its flanges, as shown in FIG. 5, at the external edges of the wedge-shaped groove 28. In this case, a radius $R_1$ is measured which, with respect to $R_1$, is not greater by the value $\Delta_2$ but by a much greater value which is a function of this angle $\rho_3$. The computer 16 can be programmed such that the limit between the radius $R_2$ and the radius $R_3$ is detected and a signal released which shows the operator that the finish-grinding wheel 12 is worn to such an extent that a corrective grinding step can no longer be performed.

Figure 6:
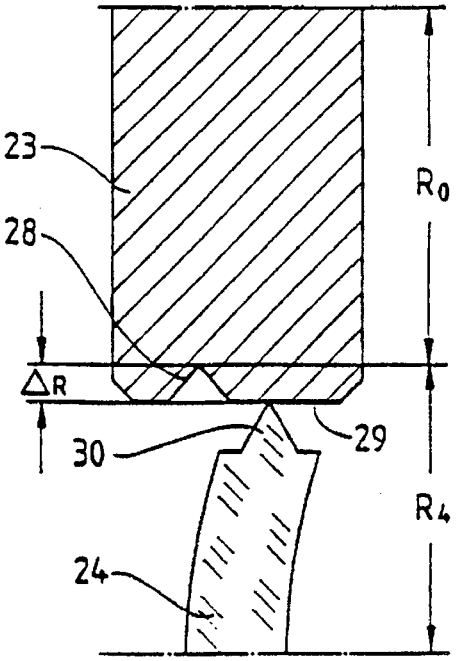
FIG. 6 a representation of measuring the radius of a circumferentially contour-ground spectacle lens in which the tip of the V-shaped bevel is placed onto the flat portion of the sensing head.

This limit can be determined easily when, as shown in FIG. 6, after measurement of the radii $R_1$, $R_2$, respectively, $R_1$ with respect to the wedge-shaped groove 28 a further radius $R_4$ is measured such that the circumferentially contour-ground spectacle lens 24 with its V-shaped bevel 30, 31, 32 is placed onto a flat area 29 of the annular segment 23. From the difference of the radii $R_1$, $R_2$, respectively, $R_3$ to the radius $R_4$ a value results directly which is greater than zero when $\rho_3>\rho_0$. This is a measured value for which causes the computer to release the aforementioned signal that a corrective grinding step is no longer possible and that the finish-grinding wheel must be exchanged or adjusted.

The comparative measurement must be performed only relative to the radius of the contour-ground spectacle lens 24 while for a more precise corrective grinding step a measurement of the entire circumference of the spectacle lens 24 within the wedge-shaped groove 28 or on the flattened portion 29 of the ring segment 23 must be carried out.

The inventive device and the method are suitable to be used with fully automated, CNC-controlled spectacle lens edge grinding machines. In these spectacle lens edge grinding machines the stored nominal values of the circumferential contour serve to control the compound slide rest carrying the grinding wheels 11 and 12 such that directly the required circumferential contour of the spectacle lens is produced.

The inventive method and the device are also suitable to be used with spectacle lens edge grinding machines in which the computer only serves to compare the actual values of the form-ground spectacle lens 24 with the stored nominal values of the circumferential contour and to perform a corrective grinding step while the actual form-grinding step of the spectacle lens is controlled by a template with the shape of the spectacle lens to be ground which is placed onto the spectacle lens holding shaft 14. The template rests in this case in a manner known per se at the abutment which is connected to the carriage part 3 and which effects the displacement of the grinding wheels 11, 12 and of the carriage part 3. For performing a corrective grinding step the abutment is adjusted by the computer 16 in correspondence to the determined deviation.

Finally, the abutment may also serve to control with the computer the displacement of the carriage part 3 and thus of the grinding wheels 11, 12 when a circular disk is resting at the abutment instead of a template with the circumferential contour of the spectacle lens to be ground.

In all cases, the measurement of the circumferentially ground spectacle lens 24 can be performed on a very narrow abutment in the form of the ring segment 23 when the spectacle lens 24 on the spectacle lens holding shaft 14 is displaced in the axial direction according to its spatial curve. This displacement in the axial direction can also be performed purely mechanically, for example, with a Panhard rod.

Of course, a measurement of the circumferential contour of the lens 24 can be performed already after pregrinding on the pregrinding wheel 11. This is advantageous because the pregrinding wheel 11 wears off faster than the fine-grinding wheel 13. Optionally, a further measurement of the circumferential contour can be eliminated completely after the finish-grinding step. However, it is also possible to perform after the finish-grinding step a measurement of the circumferential contour and to optionally perform a further corrective grinding step.

Especially during measuring of the spectacle lens after the finish-grinding step the speed of rotation of the lens holding shaft 14 can be increased in order to be able to perform the measurement faster. For this purpose, via the computer 16 a control command can be sent to the magnetic clutch 19 which reduces the pressure during measuring relative to the pressure during grinding so that wear or forming of traces on the ring segments 23, respectively, at the circumference of the spectacle lens can be avoided.

Of course, the invention can be used in an analogous manner also with spectacle lens edge grinding machines in which the grinding wheels can only be rotated but are essentially stationary, while the lens holding shaft can be radially and axially moved relative to the grinding wheels.

What we claim is:

1. A spectacle lens edge grinding machine comprising:

a machine frame;

at least one grinding wheel connected to said machine frame;

a rotatable spectacle lens holding shaft fastened to said machine frame, said spectacle lens holding shaft radially and axially displaceable relative to said grinding wheel, wherein a spectacle lens is secured to said spectacle lens holding shaft for grinding with said grinding wheel;

at least one abutment, connected to said machine frame for contacting a spectacle lens having been ground to have a desired spectacle lens contour, wherein said at least one abutment comprises a sensing head for measuring a spatial curve of the spectacle lens contour;

a transducer for detecting at least one actual radial value of the spectacle lens contour relative to said at least one abutment;

a control device for controlling an axial position of said spectacle lens holding shaft together with the spectacle lens relative to said grinding wheel as a function of said spatial curve of the spectacle lens contour, wherein said control device is operative when said at least one actual radial value is measured;

a computer for controlling said spectacle lens edge grinding machine, wherein said computer comprises a memory in which nominal values of the spectacle lens contour are stored;

wherein said computer compares said at least one actual radial value to said nominal values in order to determine a deviation from said nominal values; and wherein said memory stores a programmable threshold value for said deviation and wherein said computer controls an additional grinding step when said deviation surpasses said threshold value.

2. A spectacle lens edge grinding machine according to claim 1, wherein said abutment is a ring positioned laterally adjacent to said at least one grinding wheel so as to be stationary relative to said grinding wheel, wherein the spectacle lens after grinding the spectacle lens contour is transferred from a position at said grinding wheel to a position at said abutment.

3. A spectacle lens edge grinding machine according to claim 2, wherein said ring is comprised of ring segments.

4. A spectacle lens edge grinding machine according to claim 2, wherein one of said rings is positioned on either side of said grinding wheel.

5. A spectacle lens edge grinding machine according to claim 2, further comprising a stationary splash guard enclosing tightly said at least one grinding wheel exclusive a grinding zone for grinding the spectacle lens, wherein said rings are connected to said splash guard.

6. A spectacle lens edge grinding machine according to claim 1, wherein said at least one abutment comprises a wedge-shaped groove for detecting said at least one actual radial value of the spectacle lens, wherein lateral sides of said wedge-shaped groove are positioned at an acute angle and wherein said acute angle is identical to a maximum acute angle of a V-shaped bevel of the spectacle lens.

7. A spectacle lens edge grinding machine according to claim 6, wherein said sensing head in addition to said wedge-shaped groove has a plane area for determining said at least one actual radial value of a tip of the V-shaped bevel of the spectacle lens.

8. A spectacle lens edge grinding machine according to claim 1, further comprising a drive comprising an adjustable clutch for radially displacing said at least one grinding wheel relative to said spectacle lens holding shaft, and further comprising a switching device acting on said clutch so as to reduce a transferred torque during measuring the actual value of said spectacle lens contour.

9. A spectacle lens edge grinding machine according to claim 8, further comprising a compound slide rest connected to said machine frame, wherein said at least one grinding wheel with said drive are connected to said compound slide rest so as to be displaceable relative to said spectacle lens holding shaft, wherein said transducer measures a displacement of said compound slide rest within said machine frame relative to the spectacle lens contour.

10. A spectacle lens edge grinding machine according to claim 1, wherein said transducer is a digital transducer.

11. A method for grinding the edge of a spectacle lens with a spectacle lens edge grinding machine, said method comprising the steps of:

a) measuring at least one actual radius of a predetermined angle at a peripheral point of a spectacle lens, ground to have a spectacle lens contour, relative to an abutment, wherein said actual radius is a radius of a circumferential V-shaped bevel of the spectacle lens and is measured relative to a wedge-shaped groove of the abutment;

b) inputting the at least one measured actual radius into a computer with a memory;

c) comparing the at least one measured actual radius with a corresponding nominal radius stored in the memory of the computer to determine a deviation from said nominal radius;

d) comparing said deviation to a threshold value stored in the memory of the computer; and e) controlling with said computer an additional grinding step, when said deviation surpasses said threshold value, for correcting the spectacle lens contour in order to compensate for said deviation.

12. A method according to claim 11, wherein in said step a) said actual radius is additionally measured relative to a plane area provided at the abutment, further including the step of comparing the measured values measured relative to said wedge-shaped groove and relative to said plane surface in order to determine whether a correction of said deviation of the actual radius, measured relative to said wedge-shaped groove, is possible.

13. A method according to claim 11, wherein said step a) includes the step of rotating the spectacle lens at a rpm higher than the rpm for grinding the spectacle lens.

14. A method for grinding the edge of a spectacle lens with a spectacle lens edge grinding machine, said method comprising the steps of:

a) measuring the actual radii of the entire spectacle lens contour of a ground spectacle lens relative to an abutment;

b) inputting the measured actual radii into a computer with a memory;

c) comparing the measured actual radii with corresponding nominal radii of the entire spectacle lens contour, stored in the computer, to determine the deviations from said nominal radii;

d) comparing said deviations to a threshold value stored in the memory of the computer;

e) averaging said deviations, when said threshold value is surpassed; and f) controlling with said computer an additional grinding step based on said averaged deviations for correcting the spectacle lens contour.

15. A method according to claim 14, wherein said step a) includes the step of rotating the spectacle lens at a rpm higher than the rpm for grinding the spectacle lens.

16. A method for grinding the edge of a spectacle lens with a spectacle lens edge grinding machine, said method comprising the steps of:

a) measuring the actual radii of the entire spectacle lens contour of a ground spectacle lens relative to an abutment;

b) inputting the measured actual radii into a computer with a memory;

c) comparing the measured actual radii with corresponding nominal radii of the entire spectacle lens contour, stored in the computer, to determine the deviations from said nominal radii;

d) comparing said deviations to a threshold value stored in the memory of the computer; and e) controlling with said computer an additional grinding step for correcting the spectacle lens contour such that only such areas of the spectacle lens contour are corrected in which the deviations surpass said threshold value.

17. A method according to claim 16, wherein said step a) includes the step of rotating the spectacle lens at a rpm higher than the rpm for grinding the spectacle lens.

* * * * *